United States Patent [19]

Schmidt et al.

[11] 3,953,004

[45] Apr. 27, 1976

[54] APPARATUS FOR THE SIMULTANEOUS PUMPING-MIXING OF SEVERAL NON-MISCIBLE LIQUIDS

[75] Inventors: Pablo Schmidt; Alberto Sfeir, both of Santiago, Chile

[73] Assignee: Corporacion de Fomento de la Produccion, represented by Comite de Investigaciones Technologicas, Santiago, Chile

[22] Filed: Aug. 21, 1974

[21] Appl. No.: 499,277

[30] Foreign Application Priority Data

Aug. 22, 1973 Chile ..... 503

[52] U.S. Cl. ..... 259/23; 259/96

[51] Int. Cl.[2] ..... B01F 5/22; B01F 7/26

[58] Field of Search ..... 259/8, 23, 24, 96

[56] References Cited

UNITED STATES PATENTS

| | | | |
|---|---|---|---|
| 2,501,467 | 3/1950 | Ittner | 259/23 X |
| 2,673,075 | 3/1954 | Borck | 259/96 X |
| 3,400,915 | 9/1968 | Onishi | 259/96 X |
| 3,457,047 | 7/1969 | Tokimatsu | 250/24 X |

FOREIGN PATENTS OR APPLICATIONS

| | | | |
|---|---|---|---|
| 224,039 | 4/1970 | U.S.S.R. | 259/8 |

*Primary Examiner*—Robert W. Jenkins
*Assistant Examiner*—Alan Cantor
*Attorney, Agent, or Firm*—Karl W. Flocks

[57] ABSTRACT

Improvement and greater efficiency in pumping-mixing of several non-miscible liquids and adequate flow rate control of liquids to be mixed are obtained through the use of centrifugal rotors and suction tubes which are independent for each liquid and connected to separate flow boxes. Efficient flow rate control of each liquid is obtained by regulating the inflow inlet section of each flow box and also by the extension of the screwable suction tube into the flow box and also by properly and adequately dimensioning the rotors.

3 Claims, 8 Drawing Figures

APPARATUS FOR THE SIMULTANEOUS PUMPING-MIXING OF SEVERAL NON MISCIBLE LIQUIDS

This invention relates to apparatus for the simultaneous pumping-mixing of several non-miscible liquids.

Prior to the instant invention the mixing or agitation or both, of liquids, has been applied industrially but with attendant results.

A great variety of physicochemical processes require this operation either to produce a simple mixture of miscible liquids, a dissolution of a solid in a liquid or contacting (binding) of two non-miscible liquids. This last application is related to the present invention.

The purpose of improvement of a mixing technique is in this case to obtain a larger interphase area in order to transfer a product dissolved in one phase into the other phase. This mass transfer is carried out through the interphase and depends strongly on the interchange area.

The increment of the referred area is obtained by agitation or strongly mixing of the liquid phases in order to produce bubbles of one liquid amidst the other liquid, obtaining this way larger area of contact or transfer.

The mixing or agitation operation is performed in a particular container or tank and the dispersion of liquids is achieved by use of a propeller or impeller attached to a shaft which rotates at a certain speed that delivers enough mixing and agitation power to produce such dispersion. In this operation the efficiency of mixing and agitation is related to the geometrical shape of the tank and the type of mixer, plus other variables.

The tanks used in each mixing operation relate to the operational conditions and the type of liquids to be mixed or agitated. Circular or rectangular shaped tanks may generally be used.

The invention can best be understood by referring to the drawings in which:

FIGS. 1*a*, *b*, *c*, and *d* show agitators used in industrial operations;

The type of agitators used in industrial operations may vary from simple two blade propeller agitators up to complex rotational ones. Some examples are shown in FIG. 1.

In reference to applications made in liquid to liquid non-miscible systems it is pointed out that among practically all the types of agitators and mixers used, the most common that may be employed are those of the turbine type with two or more blades and the helicoidal type similar to the propeller of a marine motor boat. Whatever type of agitator used, the effect produced is stated as follows:

pumping and suction of one or more liquid phases into the mixer;

agitation of the liquid phases to achieve a maximum specific area;

internal recycling to homogenize the mixture.

Suctioning is practiced axially from the lower section of the tank by using a pressure difference caused by the agitator's rotation when it rotates, and mixing is achieved by a radial impulse causing the maximum turbulence in the mixer.

Other types of recycling effects are achieved by modifying the shape of the tank or by modifying the orientation of the blades of the agitator.

In the case of mixing non-miscible liquids the degree of agitation efficiency may be measured by the amount of area generated by unit of volume. Rotatory power must be transformed to the agitator, which through its rotatory motion transmits it to the liquid system.

Mixing equipment may be in the form of a great variety of geometric shapes depending on the application given. Phase contacting mixing equipment for non-miscible liquids, may be of rectangular or circular shape, generally with a major height in relation to the other dimensions. In circular tanks for example, the height may be larger than its diameter. In phase contacting mixing equipment the aim is to get an optimum flow rate control for each of the liquids that enter the mixer and to produce an efficient dispersion of the phases.

Figure 1A:
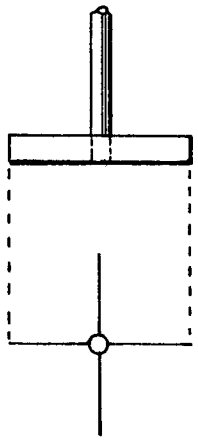
Figure 1B:
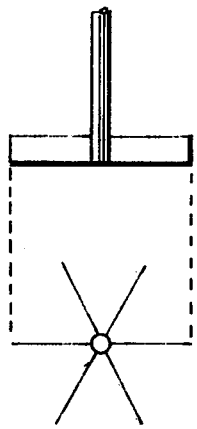
Figure 1C:
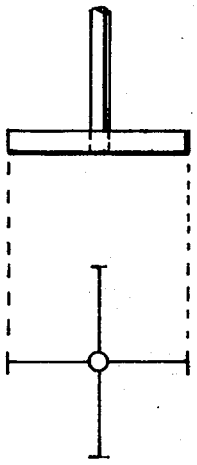
Figure 1D:
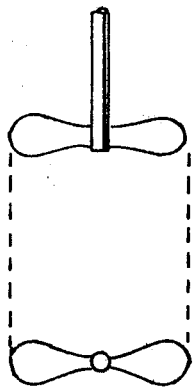
Figure 2:
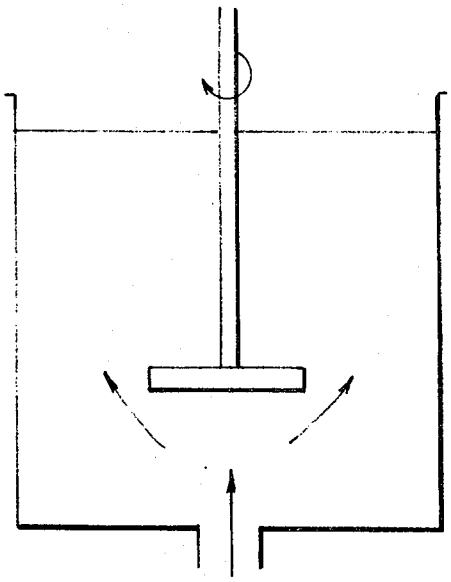
FIGS. 2 and 3 show flow patterns used.

Flow rate control may be carried out with external circulation pumps or with help of axial flow suction that the agitator generates, see FIG. 2. The latter is applied relatively well in small equipment with low flows.

The use of the agitator as means of suction or pumping, is understood by the fact that suction depends on the speed of rotation of the agitator and decreases proportionally. The agitator must be placed as close as possible to the suction inlet of the liquid(s). This suction effect decreases as the distance between the agitator and the feeding inlet increases.

These two factors, location of the agitator and high speed to produce good suction is detrimental to the agitation process. The agitation process turns less efficient due to the inadequate location of the agitator at the bottom of the tank and high turbulence developed in the system, develops emulsions that disturb the system. Therefore the application previously mentioned has strong limitations. To improve and correct those models the pumping and agitation is carried out independently.

As agitation in this kind of equipment is not thoroughly achieved, it has been necessary to implement agitation tanks with a series of accessories known as baffles or countercurrent devices. The use of such implements is justified in cylindrical shape tanks where secondary whirpool effect of the liquid around the shaft of the agitator is observed. These baffles are placed in the bottom of the liquid, always attached to the inner walls of the tank in a vertical position, coaxially with respect to the agitation axis.

Figure 3:
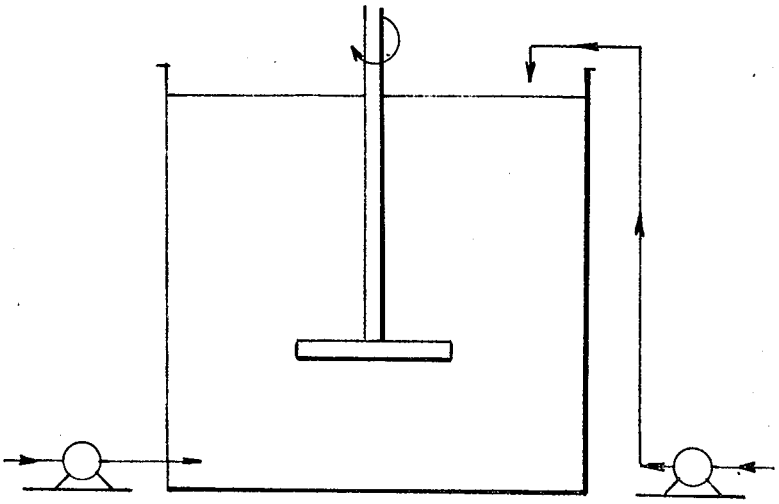

In industrial liquid-liquid contacting equipment, because of its size, external pumps and straight impelling agitation system may be employed. In this fashion, independent pumping and correct flow rate control and therefore efficient agitation of the liquid is achieved, see FIG. 3. The feeding of liquid into the tank is achieved in this case, either laterally, tangentially or through the top of the container. Flow control is achieved by use of either manually or automatically operated valves placed along the pumping line. Agitation is controlled by the size of blades of the agitator or by variation of rational speed. This requires pumps and controlling valves placed along the pumping lines and independent agitation equipment.

Figure 4:
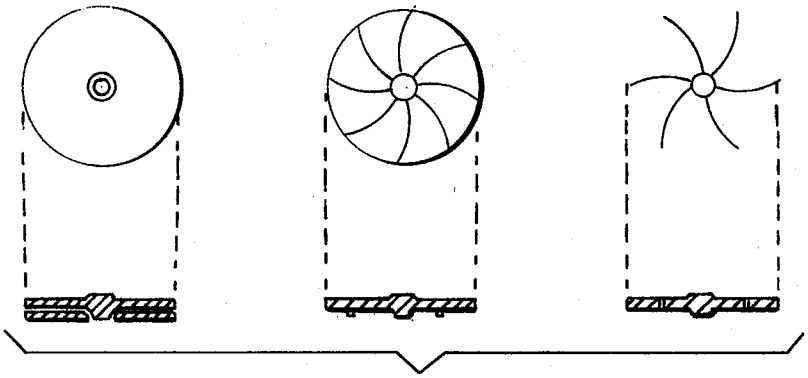
FIG. 4 shows a variety of impeller or rotor structures.

In accordance with the instant invention, centrifugal-type circulating pumps are equipped with suction and impelling systems, producing an effect similar to an agitator placed in the bottom of the liquid. The shape of such agitator is rather different, because the aim is to increase the pumping ratio instead of the mixing ratio. The variety of impeller or rotor used is large, depending on the pumping mode so desired, see FIG. 4.

This new type of rotor has a degree of dependence between rotation velocity and flow power. This relation is used to control flow rate.

Besides the possibility of varying the rotational motion in order to control the flow rate, there is another method, that is to vary the dimensions of the rotor. Increasing its diameter the pressure is increased. Increasing the distance between the two flat plates of the rotor, the flow is increased proportionally. These variations have been widely studied and applied in designing and building centrifugal pumps.

By means of a device similar to the rotor in a centrifugal pump it is possible to produce and control the pumping rate. This device is immersed in the liquid and it has an adequate suction system that allows flow control. This flow control is ensured by a geometrical dimensioning and adjusting of the device therefore varying its angular velocity.

For the application in question, that is agitation and mixing of liquids, good flow control is required that is detrimental to the liquid phases that are being treated in the mixer and enough suction is required capable of pumping the required amount of each liquid and a rather small impelling lead, because after mixing the liquids they are either poured or transferred to neighboring tanks.

The agitation effect is not directly related to the rotor or its pumping efficiency, but is rather related to the additional blades that are attached to the superior, inferior or lateral areas of the rotor. The flow generated by the rotor produces a degree of agitation or mixing that is not always sufficient to produce a good dispersion in the mixture.

The aim is to achieve an efficient agitation to the mixture, therefore radial blades are attached to the rotor in order to achieve the desired effect. See FIG. 5.

The degree of dispersion needed to induce the mixing of liquids, depends strongly on the size and shape of the blades and on the power given to the rotor expressed as rotatory motion.

Following the instant invention, the blades can be easily designed with a few trials by those skilled in the art and optimum performance can be achieved.

Besides achieving independent pumping and agitation effects, it is necessary to have efficient suction and feeding in the mixer in such a way that it affords efficient flow rate control of each liquid.

Figure 5:
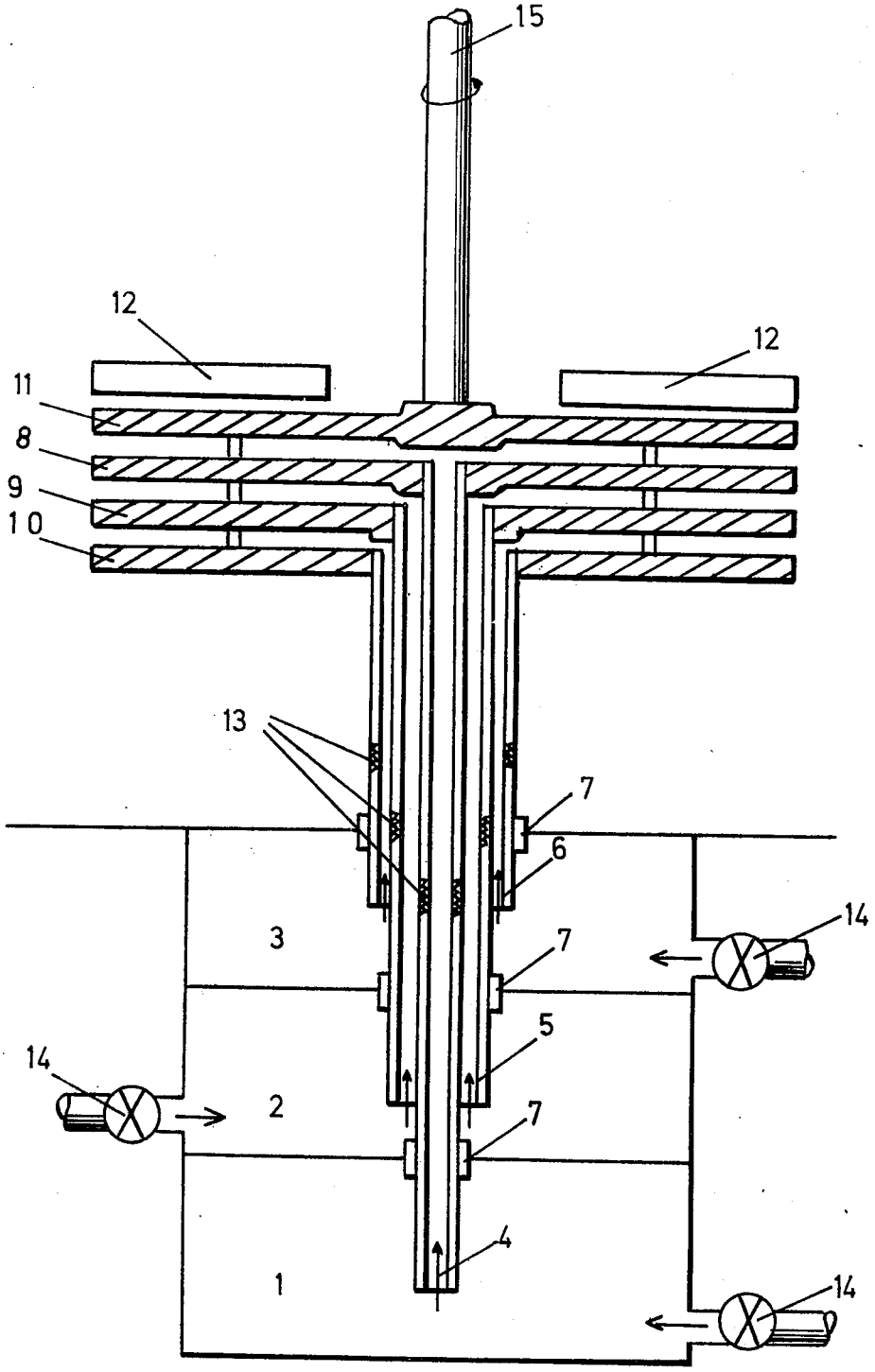
FIG. 5 is an embodiment of the apparatus of the present invention.

The suction of each liquid to be mixed or agitated, is applied to each rotor or impeller independently by means of concentrical suction tubes FIG. 5 illustrates the present invention. Central suction tube 4, middle suction tube 5, and outer suction tube 6 are concentrically inserted into each other. Rotatable impellers 8, 9, and 10 are superimposed one over the other and respectively attached to corresponding suction tubes 4, 5, and 6. Separate flow boxes 1, 2, and 3 for each liquid have the lower sections of tubes 4, 5, and 6 respectively introduced therein. The liquid in each of flow boxes 1, 2, and 3 is pulled up through the inlet ringend of the corresponding suction tube 4, 5, or 6 by the induced pumping effect due to the pressure difference produced by rotating impellers 8, 9, and 10. By adjusting the screwing unions 13 between upper and lower sections of each of suction tubes 4, 5, and 6, the desired distance is achieved from the inlet ring-end of the suction tube 4, 5, or 6 to the bottom of corresponding flow-box 1, 2, or 3, therefore regulating the flow-rate of liquid to relative volume desired. Additional control of the feeding rate may be obtained through adequate opening by the operator of admission valves 14 at the inlets of flow-boxes 1, 2, and 3. The fluids reach rotating impellers 8, 9, and 10 and are conveyed by centrifugal force to the agitation tank. Radial blades 12, attached to upper impeller 11 attached to shaft 15 of a rotor cooperate to produce a good mixing of fluids. An adequate degree of mixing is obtained through control by the operator of the rotary speed of impellers 8, 9, and 10.

In order to pump only one liquid, assuming that the other liquid or solid or gas or whatever other compound is added by other means to the tank, the device consists only of a single rotor and its respective suction tube, attaching blades to the rotor if necessary.

For pumping two liquids this device consists of two superimposed rotors, each having a suction tube. The suction tubes are concentric to the central tube. In this manner one of the liquids is suctioned through the central tube and the other by the ring amidst the other two tubes. For three or more liquids the arrangement is similar to the above-mentioned (simple rearrangement).

The way by which each liquid comes through the suction tubes is achieved by setting certain flow distribution box attached to the bottom of the agitation tank aligned axially with the pump-agitator axis.

This flow distribution box can be placed within or out of the agitation tank.

The improvement obtained by this method of impelling and mixing the liquids can be shown by comparing it with other previous methods. One of the oldest methods consisted of a single propeller with several blades attached to it, immersed in the liquid. By spinning this propeller the liquid undergoes a whirpool motion, therefore achieving enough agitation of the liquid.

This method has been studied and optimum operational conditions are understood. Conditions such as rotational speed, adequate shape of the propeller blades, angle of inclination of the blades, are calculated upon the relation existing between the shape of the mixing tank and the interior arrangement of baffles.

With this method good agitation is obtained but controlled feeding, with pre-established flows can be achieved only with use of auxiliary pumps.

This method was improved again by placing the propeller over the orifice where the liquids are fed into the mixing tank.

With this procedure it is possible to induce a pumping effect due to the pressure differential produced by the propeller when it whirls. The inconvenience is that if the propeller is placed too close to the feeding orifice, in order to produce pumping effect, two major problems are derived: One is that efficiency in the agitation of the mixture is reduced, due mainly to the relative position of the propeller at the bottom of the mixer. This implies attaching another propeller to the axial shaft, half way from the bottom of the tank. In this manner we ensure good mixing. The other problem is that in order to increase the flow of the liquids, the radial velocity of the propeller must be increased, causing this way the formation of emulsions.

By all means, this procedure allows only efficient agitation. Independent flow rate control of either liquid is unattainable due mainly to the differential pressure created by the propeller that impedes simultaneous feeding of both liquids into the feeding orifice.

Another type of mixer developed later, consisted of a centrifugal impeller placed by the agitator with its suction connections attached to the feeding box of the liquids. This caused better feeding even though the flows could not be varied independently.

Physically the impeller was located at the center of the mixer, connected to the flow box by a suction tube. By its rotation a good pumping effect is obtained, that is useful for systems that do not require strong agitation.

The flow rate control of two liquids can be achieved either simultaneously by the impeller or one liquid through the impeller and the other liquid pumped by auxiliary pumps into the mixer. The improved system in accordance with the invention has the following advantages over the previous ones:

a. By means of dimensioning of conventionally one or more impellers that perform pumping and agitation, a more accurate flow rate control or feeding rate for each liquid separately can be achieved. Each rotor is placed on top of the other. In this fashion each rotor will have its own dimensions for a particular pre-established flow rate of each liquid separately. The previous dimensioning of the assembled rotors allows the feeding ratio of liquids to be kept constant within a wide range of speeds. If feeding and flow ratios of one liquid at a time are varied, a small valve is attached to the flow box inlet of the corresponding liquid.

b. The mixing of liquids can be modified in any given situation when the range of speeds that allows adequate pumping of liquids has been settled. This is done by conventionally giving the right size to the blades of the impeller (rotor). The blades are placed radially over the superimposed rotors.

The system conceived this way, gives the operator several additional parameters in order to control independently flow and agitation rates:

a. By varying the annular velocity the liquid flow varies at a pre-established rate, increasing only the total flow.

b. By means of detachable blades a better performance is achieved in each situation encountered.

c. For more accuracy, the flow of each liquid can be modified independently, causing a minimum lost of pressure head in the feeding line of each liquid, by placing a valve or a simple gate operated by hand.

d. Each suction tube has its upper section affixed to the rotor and therefore to the axis, and the lower section screwed in it. This permits adjustment of the length of any suction tube inside the flow box. This generates a pressure head loss at the entrance to the suction tubes abovementioned, varying the delivery of liquid in this way.

The flow box can be placed either within or underneath the agitation tank, if necessary.

For instance, in the case of two liquids, there is a horizontal compartment for each liquid and eventually a third one in the case of recycling.

This mixer-pump device is adequate for liquid-liquid ion-exchange where mixing and flow control efficiency is absolute necessary in the process.

This device permits the adequate design of ion-exchangers (mixer-settlers) in an arrangement that provides for the use of compact reactors.

The operational characteristics that are set forth next are examples of the effect produced by this device.

Table 1

Tabulation curves of flow vs. angular velocity of the rotor, in case of two superimposed rotors, with independent suction tubes and flow box inlets fully opened.

Suction tube area ratio: $A_1/A_{11} = 1/8$.

Table (a): flow suctioned by rotor 1.

Table (b): flow suctioned by rotor 11.

Table (c): flow suctioned by rotor 1 and 11.

Table 2

A way of flow control, by reducing the inlet section to the flow box, suctioning rotor 11.

Table (a): fully opened inlet section: $A_1$.

Table (b): section ratio: $A_2/A_1 = 1/2$.

Table (c): section ratio: $A_3/A_1 = 1/4$.

Table 3

Id. table 2, for rotor 1.

Table (a): fully opened inlet section: $A_1$.

Table (b): section ratio: $A_2/A_1 = 1/4.5$.

Table (c): section ratio: $A_3/A_1 = 1/9$.

Table 4

Tabulation of flow vs. angular velocity of a rotor with two suction tubes.

Suction tube area ratio: $A_1/A_{11} = 1/7.3$.

Table (a): suction flow for tube 11.

Table (b): suction flow for tube 1.

Table (c): suction flow for tube 1 and 11, coincides with suction of tube 11.

TABLE 1

| Table (a) | | Table (b) | | Table (c) | |
|---|---|---|---|---|---|
| Q/Qo | N/No | Q/Qo | N/No | Q/Qo | N/No |
| 0.4 | 0.11 | 0.4 | 0.38 | 0.4 | 0.47 |
| 0.5 | 0.14 | 0.5 | 0.46 | 0.5 | 0.59 |
| 0.6 | 0.16 | 0.6 | 0.56 | 0.6 | 0.70 |
| 0.7 | 0.19 | 0.7 | 0.65 | 0.7 | 0.81 |

TABLE 2

| Table (a) | | Table (b) | | Table (c) | |
|---|---|---|---|---|---|
| Q/Qo | N/No | Q/Qo | N/No | Q/Qo | N/No |
| 0.4 | 0.26 | 0.4 | 0.34 | 0.4 | 0.38 |
| 0.5 | 0.33 | 0.5 | 0.42 | 0.5 | 0.46 |
| 0.6 | 0.38 | 0.6 | 0.50 | 0.6 | 0.55 |
| 0.7 | 0.46 | 0.7 | 0.61 | 0.7 | 0.65 |

TABLE 3

| Table (a) | | Table (b) | | Table (c) | |
|---|---|---|---|---|---|
| Q/Qo | N/No | Q/Qo | N/No | Q/Qo | N/No |
| 0.4 | 0.07 | 0.4 | 0.1 | 0.4 | 0.12 |
| 0.5 | 0.085 | 0.5 | 0.12 | 0.5 | 0.135 |
| 0.6 | 0.11 | 0.6 | 0.14 | 0.6 | 0.16 |
| 0.7 | 0.115 | 0.7 | 0.165 | 0.7 | 0.19 |

TABLE 4

| Table (a), (c) | | Table (b) | |
|---|---|---|---|
| Q/Qo | N/No | Q/Qo | N/No |
| 0.4 | 0.14 | 0.4 | 0.27 |
| 0.5 | 0.16 | 0.5 | 0.36 |
| 0.6 | 0.18 | 0.6 | 0.42 |
| 0.7 | 0.215 | 0.7 | 0.48 |

What is claimed is:

1. Apparatus for the simultaneous pumping-mixing of several non-miscible liquids comprising a rotor disposed within an agitation tank, said motor comprising several rotatable centrifugal impellers superimposed one over the other; concentrical suction tubes inserted into each other, each of said suction tubes being attached to one of said impellers; a lower section of each said suction tube being introduced into corresponding separate flow boxes for each liquid, said lower section being screwable to an upper section of the same said suction tube; said separate flow-boxes being installed underneath and aligned axially to said rotor.

2. The apparatus as claimed in claim 1, wherein admission valves are inserted at inlets of said flow-boxes.

3. The apparatus as claimed in claim 1, wherein said impellers comprise radially disposed blades.

* * * * *